US007102472B1

(12) United States Patent
Nathanson et al.

(10) Patent No.: US 7,102,472 B1
(45) Date of Patent: Sep. 5, 2006

(54) MEMS DEVICE

(75) Inventors: Harvey C. Nathanson, Pittsburgh, PA (US); Christopher Kirby, Gambrills, MD (US); Robert Tranchini, Ellicott City, MD (US); Robert M. Young, Ellicott City, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 57 days.

(21) Appl. No.: 10/839,241

(22) Filed: May 6, 2004

(51) Int. Cl.
*H01H 51/22* (2006.01)

(52) U.S. Cl. ..... 335/78; 200/181

(58) Field of Classification Search ..... 335/78; 200/181
See application file for complete search history.

(56) References Cited

U.S. PATENT DOCUMENTS 5,673,785 A 10/1997 Schlaak et al.
6,396,372 B1 5/2002 Sakata et al.

*Primary Examiner*—Elvin Enad
*Assistant Examiner*—Bernard Rojas
(74) *Attorney, Agent, or Firm*—Birch, Stewart, Kolasch & Birch, LLP

(57) ABSTRACT

A MEMS device having a support frame positioned on a substrate surrounding a first electrode. A rigid flange portion at the top of the support frame is closely space from, and is connected to, a second electrode by relatively short spring members. RF conductors connected to respective first and second electrodes complete an RF switch. A dielectric layer on the first electrode forms a capacitive type device and includes an electrostatic shield layer on its surface. This electrostatic shield layer is connected to ground by a multi megohm bleeder resistance.

21 Claims, 6 Drawing Sheets

MEMS DEVICE

BACKGROUND OF THE INVENTION

1. Field of the Invention

The invention in general relates to miniature switches, and more particularly, to a capacitive type MEMS switch useful in radar and other microwave applications.

2. Description of Related Art

A variety of MEMS (microelectromechanical systems) devices are used as switches in radar and communication systems, as well as other high frequency circuits for controlling RF signals. These MEMS switches are popular insofar as they can have a relatively high off impedance, with a low off capacitance, and a relatively low on impedance with a high on capacitance, leading to desirable high cutoff frequencies and wide bandwidth operation. Additionally, the MEMS switches have a small footprint, can operate at high RF voltages and may be constructed by conventional integrated circuit fabrication techniques.

Many of these MEMS switches generally have electrostatic elements, such as opposed electrodes, which are attracted to one another upon application of a DC pull down control voltage. In a capacitive type MEMS switch one electrode is on a movable bridge while the opposed electrode, generally the one with a dielectric layer, is on a substrate member. Upon application of the DC pull down control voltage, the bridge is deflected down and, by the particular high capacitive coupling established, the electrical impedance is significantly reduced between first and second spaced apart RF conductors on the substrate member, thus allowing a RF signal to propagate between the first and second conductors.

With this arrangement, the full pull down voltage appears across the dielectric layer resulting in a relatively high electric field across the dielectric. Over time, this high field may lead to charge accumulation on the surface, as well as in the bulk dielectric. Once the dielectric accumulates enough charge, the switch may fail because the charge causes the switch to remain closed even after the pull down voltage is removed.

Additionally, any presence of water vapor molecules may result in positive ions being formed, due to the electrostatic fields generated, with these positive ions migrating across the substrate and on the dielectric. These positive ions induce corresponding negative charges on the undersurface of the movable bridge and its electrode. Further consequences of these charges include, a pull down voltage shift with time, an incomplete, non uniform pull down across the electrode, resulting in a decrease or increase in capacitance and electrode drop out.

It is a primary object of the present invention to obviate the drawbacks associated with the typical prior art MEMS device.

SUMMARY OF THE INVENTION

A MEMS device is described and includes a substrate and first and second opposed electrodes, with the first electrode being positioned on the substrate. A support frame on the substrate substantially surrounds the first electrode, and includes a top portion which may have an inwardly projecting flange portion. A spring arrangement connects the top portion of the support frame to the second electrode, defining a gap therebetween. The dimension of the gap is 25% or less of the maximum surface dimension of the second electrode. An RF switch is defined by connecting first and second RF conductors to respective first and second electrodes.

In another aspect, a MEMS device is described which includes first and second opposed electrodes, one of which includes a dielectric layer. An electrostatic shield is deposited on the dielectric layer and is connected to ground by a very high resistance in the order of 10 megohms or higher. The bleeder resistance may be a resistor or reversed biased diode, by way of example.

Further scope of applicability of the present invention will become apparent from the detailed description provided hereinafter. It should be understood, however, that the detailed description and specific example, while disclosing the preferred embodiment of the invention, is provided by way of illustration only, since various changes and modifications within the spirit and scope of the invention will become apparent to those skilled in the art, from the detailed description.

BRIEF DESCRIPTION OF THE DRAWINGS

The present invention will become more fully understood from the detailed description provided hereinafter and the accompanying drawings, which are not necessarily to scale, and are given by way of illustration only, and wherein.

DESCRIPTION OF THE PREFERRED EMBODIMENT

Figure 1:
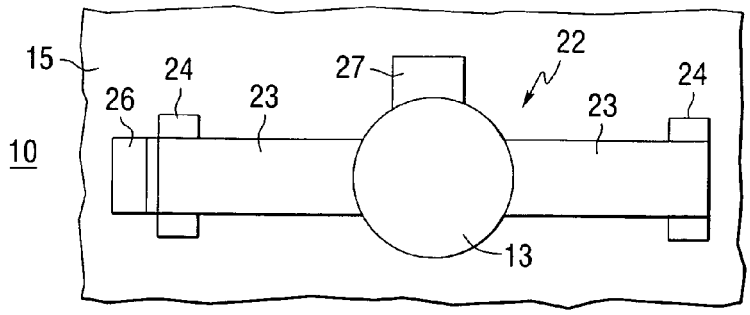
FIG. 1 PRIOR ART
FIG. 1 is a simplified plan view of a well-known type of capacitive MEMS switch.
Figure 2:
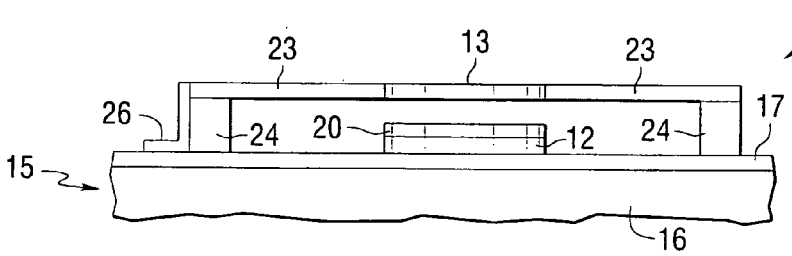
FIG. 2 PRIOR ART
FIG. 2 is a side view showing the switch in an open condition.

Referring now to the plan and side views of FIGS. 1 and 2, there is illustrated a well-known type of MEMS device 10. The device includes first and second opposed electrodes 12 and 13, one of which, electrode 12, is stationary and the other one of which, electrode 13, is moveable.

Stationary electrode 12 is formed on a substrate 15, generally comprised of a base 16 of semiconductor material such as gallium arsenide, silicon or alumina, by way of example, over which is deposited an insulating layer 17. A dielectric layer 20 such as silicon dioxide or silicon nitride is deposited on the surface of stationary electrode 12.

Figure 3:
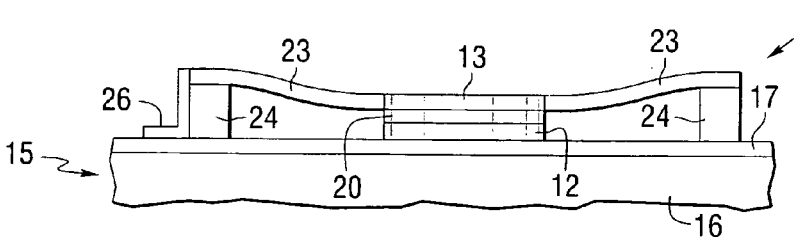
FIG. 3 PRIOR ART
FIG. 3 is a view, as in FIG. 2, showing the switch in a closed condition.

The moveable electrode 13 is part of a moveable bridge arrangement 22 which includes flexible spring arms 23 connecting the electrode 13 to supports 24. When the device is to be utilized as a microwave switch, first and second RF conductors 26 and 27 are provided and are electrically connected to respective electrodes 12 and 13. When an appropriate pull down voltage is applied to one of the electrodes, electrostatic attraction will cause electrode 13 to move to the position illustrated in FIG. 3. Under such condition, the impedance between RF conductors is greatly reduced, allowing propagation of an RF signal between the RF conductors, until such time that the pull down voltage is removed, thus breaking the RF connection.

Figure 4:
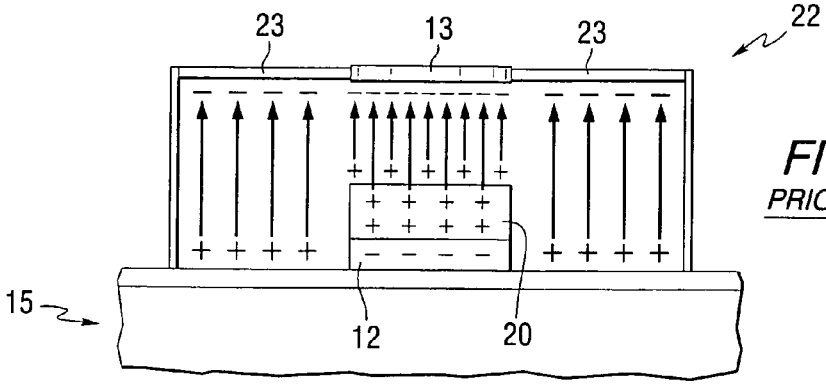
FIG. 4 PRIOR ART
FIG. 4 is a presentation of the switch to illustrate certain charges.

FIG. 4 is a representation of the switch of FIGS. 1 and 2 to illustrate certain problems associated with the switch. One problem is related to the continued application of pull down voltage during operation. Over time the high electrostatic field generated may lead to charge accumulation in the dielectric layer 20 as well as on the dielectric layer, as indicated by the "+" signs in, and on the surface of the dielectric layer 20. These positive charges induce corresponding negative charges on the electrode 13, as indicated by the "−" signs on the undersurface of electrode 13. This situation may lead to a failure of the switch in that the switch may remain in a closed condition even after the pull down voltage is removed.

Another problem is associated with the formation of positive charges resulting from positive ions being generated from the presence of water vapor under the influence of the electrostatic fields present in the system. These positive charges form on the substrate 15 below the spring arms 23 and may migrate over the dielectric layer 20. These charges induce corresponding negative charges on the undersurface of the spring arms 23 as well as electrode 13. This condition can adversely affect the bridge position vs. voltage behavior such as by causing variation in pull down voltage with time, uneven pull down of the electrode and can even cause switch drop out.

Figure 5:
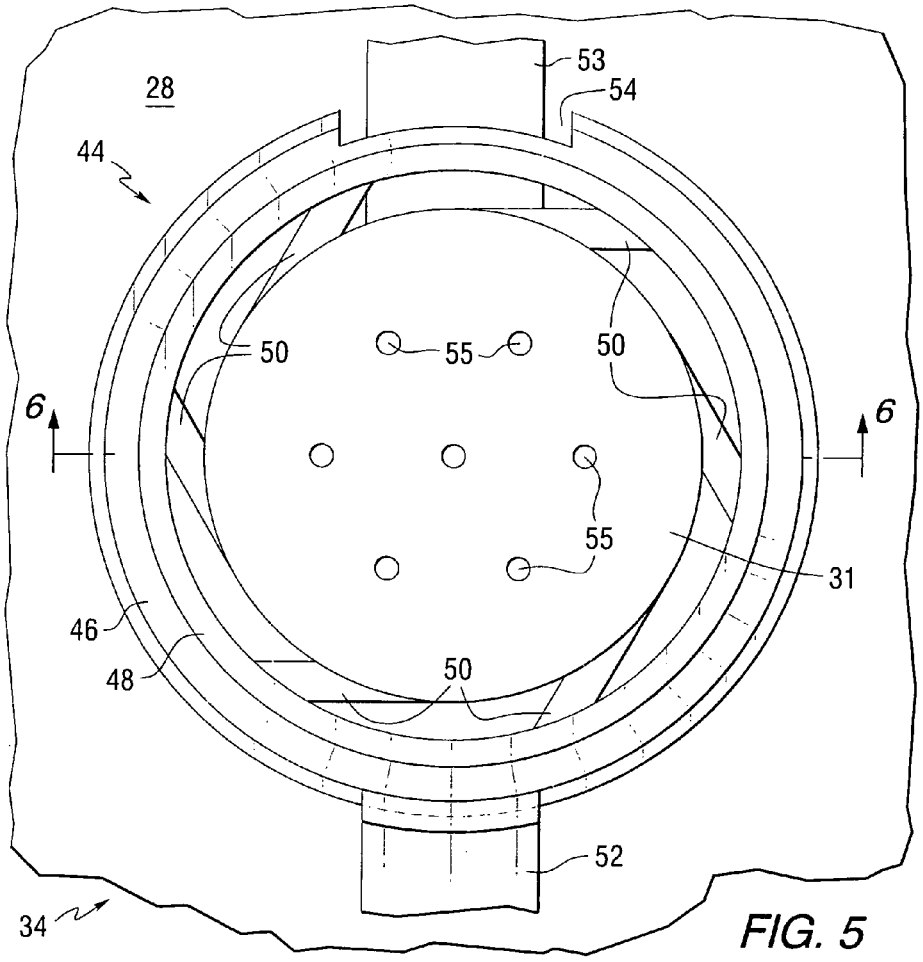
FIG. 5 is a plan view of an improved MEMS switch.
Figure 6:
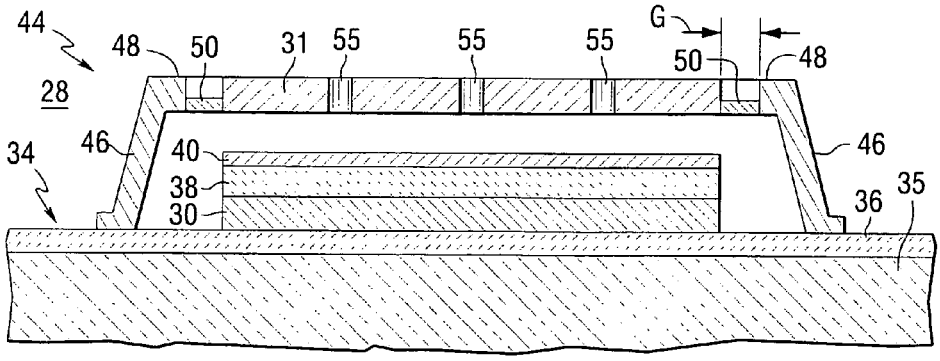
FIG. 6 is a view of the switch along the line 6—6 of FIG. 5.

FIGS. 5 and 6 illustrate, in plan and cross-sectional side view respectively, a MEMS device 28 which substantially eliminates the aforementioned problems. MEMS device 28 includes first and second spaced apart electrodes 30 and 31, with stationary electrode 30 being formed on substrate 34, comprised of a base 35 and insulating layer 36. A dielectric layer 38 is deposited on the surface of electrode 30 and a relatively thin electrically conducting, metal electrostatic shield layer 40 is deposited over the surface of dielectric layer 38. With a gold electrostatic shield 40, a relatively thin adhesive layer (not shown) would first be applied to the surface of dielectric layer 38 prior to deposition of the gold.

A support frame 44, positioned on substrate 34, substantially surrounds the electrode 30 and includes a side wall portion 46 and preferably, a rigid inwardly projecting flange portion 48 at the top thereof. The moveable electrode 31 is connected to the flange 48 by a spring arrangement comprised of a series of relatively thin, flexible spring members 50 so as to allow movement of electrode 31 to contact electrostatic shield 40, when a pull down voltage is applied. In the fabrication of the device, electrode 31, flange 48 and spring members 50 may be formed at the same time with equal thicknesses. In a preferred embodiment however, electrode 31 and flange 48 are made thicker than spring members 50, as illustrated in FIG. 6.

The design of the switch is such that the electrode 31 is extremely close to the support, more particularly to the flange portion 48. This proximity is denoted by the distance G in FIG. 6, where G is 25% or less of the largest surface dimension of the electrode 31. In the case of a circular electrode, as in FIGS. 5 and 6, this largest dimension would be its diameter.

Each spring member 50 is tangential to the circular electrode 31. The close proximity of the movable electrode 31 to the flange portion 48 permits the use of very short and very thin spring members 50, ensuring for uniform piston like movement of the electrode 31, while allowing for a slight twisting movement to aid in smoothing mating surfaces of electrode 31 and electrostatic shield 40 during continued operation of the device. Additionally, the arrangement of short narrow springs means that a lower than normal pull down voltage may be used, for example, less than 10 volts, leading to a thinner than normal dielectric layer 38 without dielectric breakdown.

For use as an RF switch, the MEMS device 28 would include first and second RF conductors 52 and 53, electrically connected to respective electrodes 31 and 30, with RF conductor 53 extending past support frame 44 via an opening 54 in sidewall portion 46. In order to reduce the effects of damping of electrode 31 when being pulled down, electrode 31 includes a plurality of antidamping apertures 55 through the top surface thereof.

Figure 7:
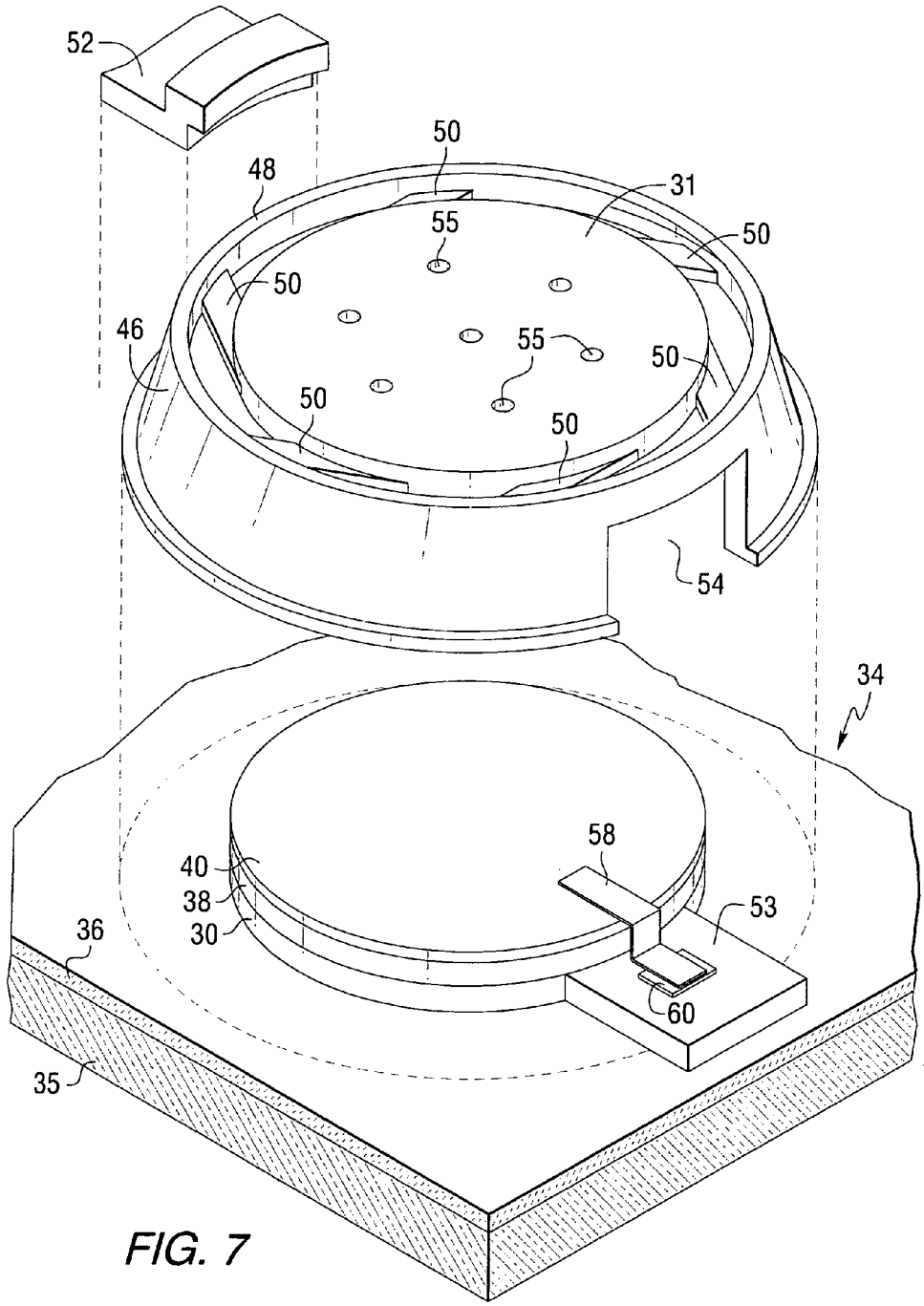
FIG. 7 is an exploded view illustrating several components of the switch of FIG. 5.

With reference to FIG. 7, illustrating a portion of the switch, the electrostatic shield 40 is connected, by means of strap 58 to a bleeder resistance 60, having a relatively high resistance value, for example, 10 to 1000's of million ohms (megohms).

Figure 8:
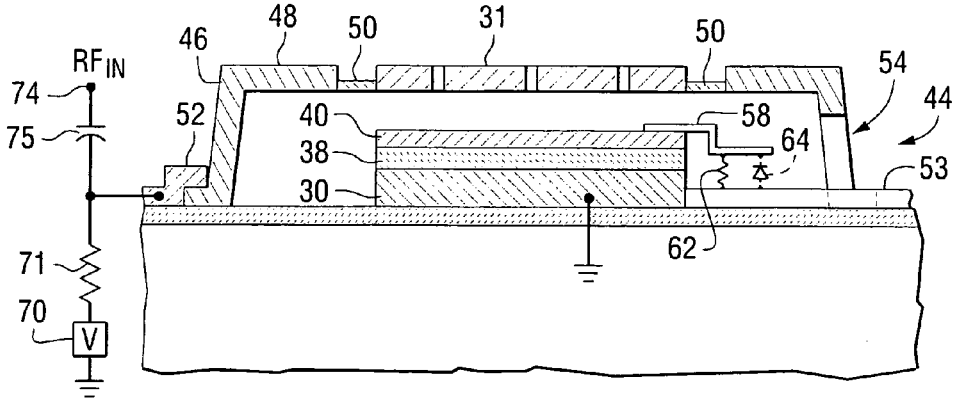
FIG. 8 illustrates several electrical connections to the switch.

FIG. 8 illustrates some electrical connections. Electrode 30 is connected to ground potential and electrostatic shield 40 is connected to ground through bleeder resistance 60, which may be constituted by a polysilicon resistor 62, or a reversed biased Schottky or P-N junction diode 64, by way of example.

A source of pull down voltage 70 applies an appropriate pull down voltage, through resistor 71, to moveable electrode 31 via the path which includes RF conductor 52, support frame 44 and spring members 50. An RF signal to be coupled between RF conductors 52 and 53 is applied to electrode 31 via the path which includes terminal 74, coupling capacitor 75, RF conductor 52, support frame 44 and spring members 50, and then to RF conductor 53 when the pull down voltage is applied.

Figure 9:
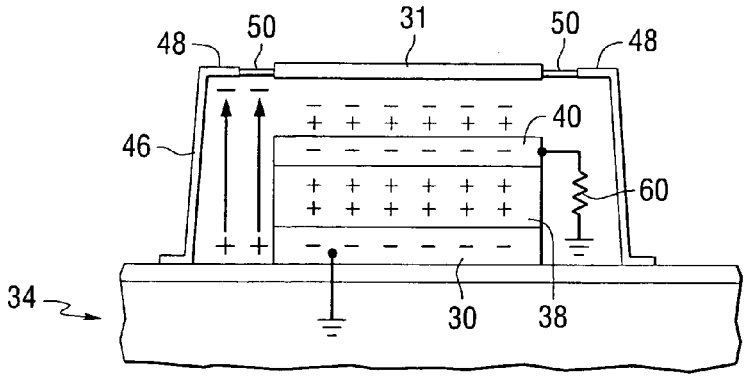
FIG. 9 is a view, as in FIG. 4, illustrating the charges on the switch of FIG. 5.

FIG. 9 is a presentation, as in FIG. 4, illustrating the charge distribution with the structure of the MEMS switch of FIGS. 5 and 6. Positive charges on the surface of substrate 34, due to ionization of water vapor molecules, induce a corresponding negative charge on the underside of flange 48. Since this flange is relatively rigid it will have no, or inconsequential movement, as a result of such charge. Charge may also be induced on the underside of spring members 50, however the area of each such spring 50 is small, and the total spring area is significantly less that that of the prior art spring arms 23 (FIGS. 1 and 2). Therefore, the induced charge will have little effect on the operation of the switch.

Induced positive charge at the surface of dielectric layer 38 induces a corresponding negative charge, not in the electrode 31, as in the prior art case, but rather, in the electrostatic shield 40. Further, any surface charge due to water vapor ionization which migrates to the surface of electrostatic shield 40 is neutralized by electrons resulting from the bleeder resistance connection to ground. Therefore with the present arrangement, the pull down voltage characteristic as a function of time is not affected, thereby ensuring switch reliability.

Figure 10:
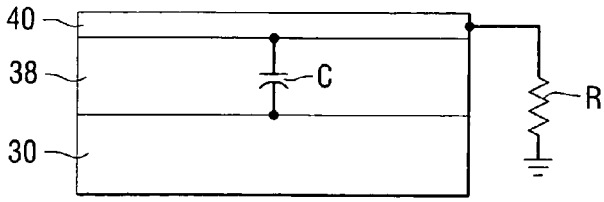
FIG. 10 serves to illustrate components in the derivation of a time constant.

In FIG. 10, the capacitance defined by the electrode 30, dielectric layer 38 and electrostatic shield 40 has a value of C and the bleeder resistance 60 has a value of R. For proper operation, the time constant RC is made at least 10 times, and preferably 100 times longer than the mechanical time constant of the switch structure, which is defined as ½ f, where f is the mechanical resonance of the electrode structure 31 and associated springs. This ensures that during the movement of the electrode 31 toward the electrostatic shield 40, the electrostatic shield 40 will remain electrically floating and will approach the pull down voltage value when contact is made. There will be no significant charge flow of current in the multimegohm resistor to affect the voltage on the electrostatic shield 40.

Further, in order to prevent the moving electrode 31 from chattering at the RF frequency, the mechanical time constant is made much larger than the microwave period. For example typical time constants for the electrostatic shield/bleeder resistor, moving electrode 31 and the microwave period of the lowest microwave frequency of interest are 5 milliseconds, 5 microseconds and 5 nanoseconds, respectively.

Figure 11:
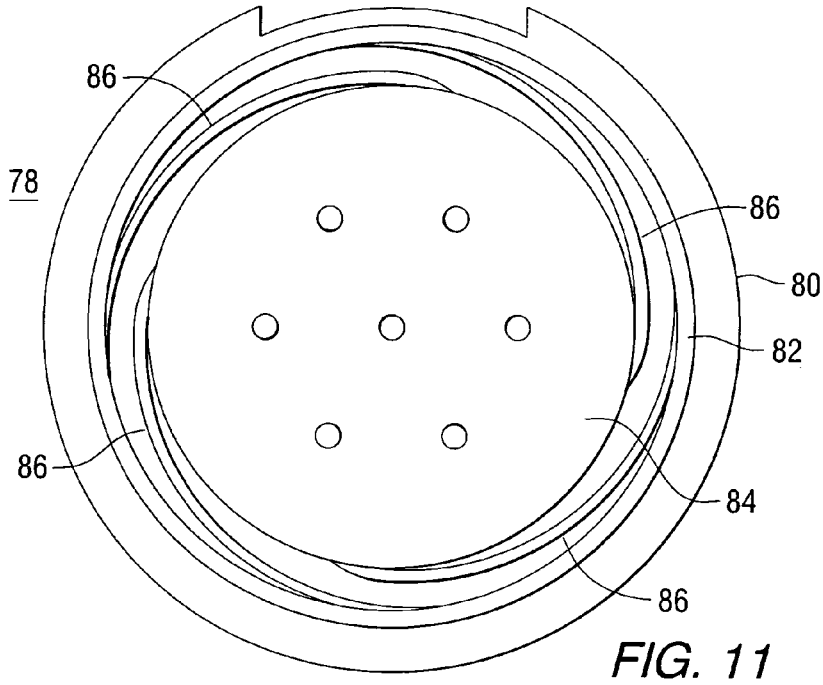
FIGS. 11–13 are plan views of alternate electrode structures for the switch of FIG. 5.

It may be demonstrated that a structure as shown in FIGS. 5 and 6 will exhibit a high on/off capacitance ratio of around 100:1 with the following parameters:

Electrode 31 thickness:—1.5 μm
Electrode 31 diameter:—80 μm
Electrode 30 thickness:—0.5 μm
Electrode 30 diameter:—80 μm
Dielectric 38 thickness:—750 Å (0.075 μm)
Shield 40 thickness:—50 Å (0.005 μm)
Separation between electrode 31 and shield 40:—2.0 μm
Width of spring members 50:—10 μm
RF frequency of operation:—10 GHz FIG. 11 is a plan view, as in FIG. 5, illustrating an alternate spring arrangement. The MEMS device 78 includes support frame 80 having inwardly projecting flange portion 82 surrounding a moveable apertured electrode 84. The spring arrangement is comprised of a plurality of curvilinear spring members 86 connecting the electrode 84 with the flange portion 82. Four spring members are shown, each connected to a respective point on the electrode 84 and curving to an attachment point 90° away on the flange portion.

Figure 12:
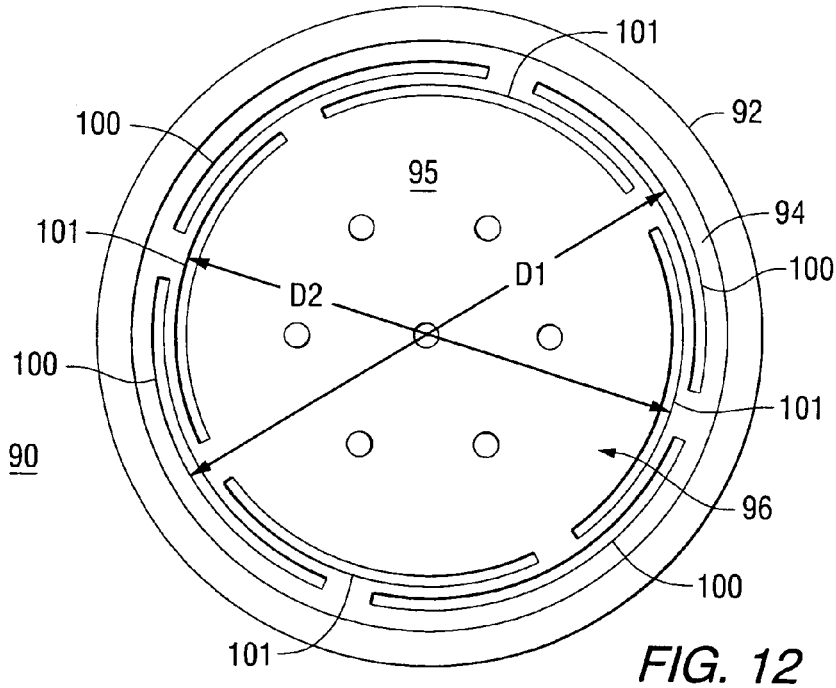

FIG. 12 is also a plan view, as in FIG. 5, illustrating an arrangement which will allow air to move in and out of the structure but will filter unwanted particles. MEMS device 90 includes a support frame 92 and a flange portion 94. The top 95 of the device is defined by an apertured electrode 96 integral with flange portion 94. A first series of slots 100 is formed in the top 95 and lie along a circle of diameter D1. In order to provide the necessary spring action to enable electrode 96 to pull down when a pull down voltage is applied, a second series of slots 101 is also formed in the top 95. These slots 101 lie on a circle of diameter D2, which is smaller than D1 and are offset from slots 100 so as to overlap them. Both sets of slots 100 and 101 are very narrow and have a width in the range of 0.1 μm to 1.0 μm. This ensures that air may move in and out of the structure while the 0.1 μm to 1.0 μm width prevents large particles from entering the structure under the electrode 96. Thus the structure acts as a self-contained filter for particles greater than the slot width.

Figure 13:
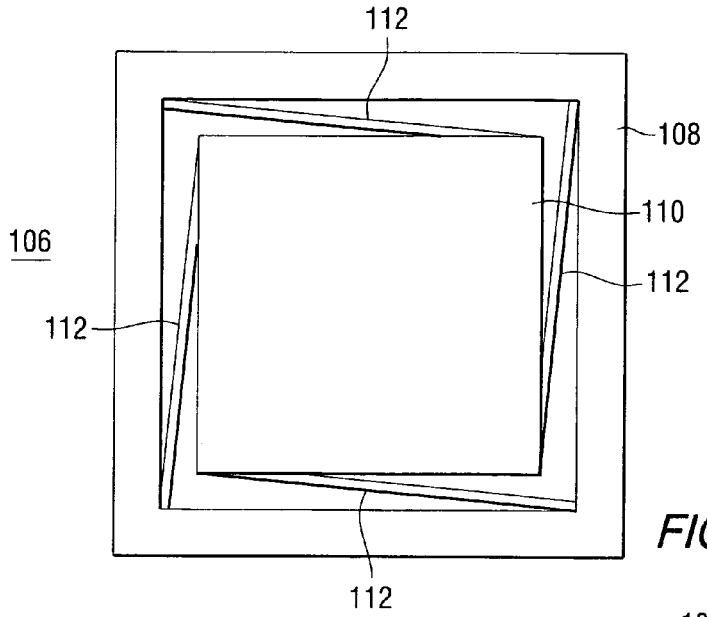

FIG. 13 is a plan view of a MEMS device 106 having a square support frame 108 surrounding a moveable electrode 110. Connecting the electrode 110 to the support frame 108 is a spring arrangement consisting of linear spring members 112.

Figure 14:
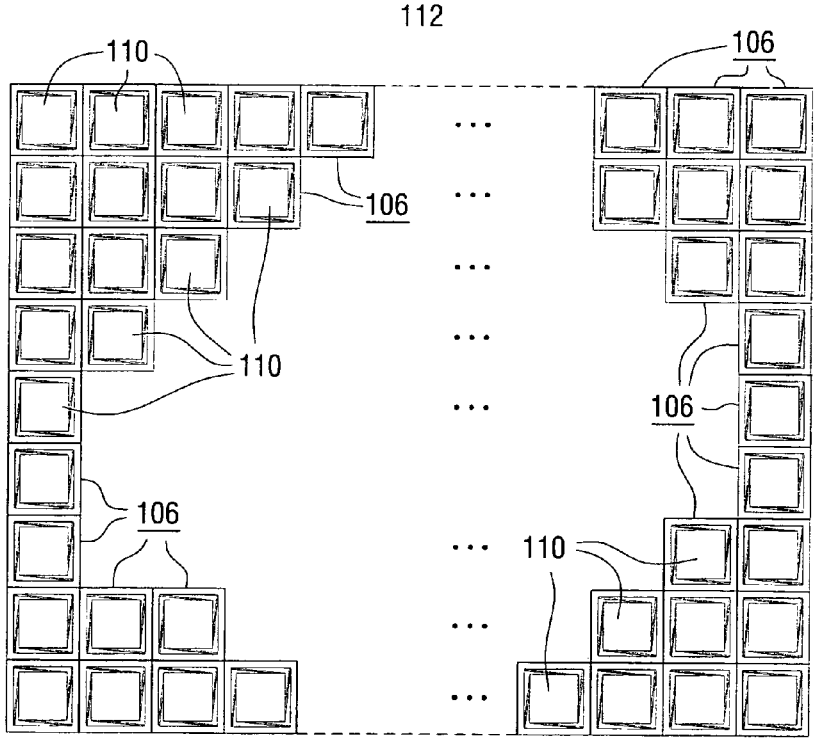
FIG. 14 illustrates an X-Y array of the devices of FIG. 13.

The device of FIG. 13, without RF conductors, is particularly well adapted to be utilized in an optical system. More particularly, and by way of example, FIG. 14 illustrates an X-Y array of MEMS devices 106 of FIG. 13. The support portions 108 may be at ground potential and a variable voltage may be applied to the opposing stationary electrode (not seen) to proportionally move the electrode 110 anywhere between a fully up and a fully down position. In this manner, a predetermined topographical surface may be generated, such surface, in conjunction with a laser beam, may be used for holographic applications.

Accordingly, there has been described a MEMS device which has RF switching, as well as optical uses. The device has a relatively small footprint compared to conventional devices with the same size moving electrode and can be operated at pull down voltages significantly less that prior art devices. The structure can be incorporated in metal-to-metal contact as well as capacitive RF switches and the electrostatic shield concept may be used in various structural types of MEMS switches.

The foregoing detailed description merely illustrates the principles of the invention. It will thus be appreciated that those skilled in the art will be able to devise various arrangements which, although not explicitly described or shown herein, embody the principles of the invention and are thus within its spirit and scope.

What is claimed is:

1. A MEMS device, comprising:
a substrate;
first and second opposed electrodes, said first electrode being positioned on said substrate;
a dielectric layer located on said first electrode;
an electrostatic shield layer deposited on said dielectric layer;
a support frame including a top portion positioned on said substrate substantially surrounding said first electrode, said dielectric layer and said electrostatic shield layer;
said top portion having an inwardly projecting flange portion;
a spring arrangement connected between said flange portion and said second electrode, defining a gap therebetween;
the dimension of said gap being 25% or less of the maximum surface dimension of said second electrode; and
said first and second opposed electrodes being drawn to one another upon application of a pull down voltage to one of said electrodes.

2. A MEMS device according to claim 1 wherein:
the thickness of said flange portion is equal to the thickness of said second electrode.

3. A MEMS device according to claim 2 wherein:
the thickness of said flange portion is greater than the thickness of said spring arrangement.

4. A MEMS device according to claim 1 wherein:
said spring arrangement includes a plurality of spaced apart spring members connecting said second electrode with said flange portion of said support frame.

5. A MEMS device according to claim 4 wherein:
said second electrode is circular; and
said spring members are tangential to said circular second electrode.

6. A MEMS device according to claim 5 wherein said spring members comprise curvilinear spring members.

7. A MEMS device according to claim 1 which includes:
a plurality of apertures through said second electrode to prevent damping when said second electrode moves toward and away from said first electrode during operation of said device.

8. A MEMS device according to claim 1 which includes:

first and second RF conductors electrically connected to respective said first and second electrodes.

9. A MEMS device according to claim 8 wherein:

said RF conductors are positioned on said substrate.

10. A MEMS device according to claim 1 which includes:

a bleeder resistance connected to said electrostatic shield layer.

11. A MEMS device according to claim 10 wherein:

said bleeder resistance has a value of at least 10 megohms.

12. A MEMS device according to claim 11 wherein:

said bleeder resistance is a resistor.

13. A MEMS device according to claim 11 wherein:

said bleeder resistance is a reversed biased diode.

14. A MEM device according to claim 1 wherein said support frame comprises a square support frame having four inner corners, said first electrode comprises a rectilinear electrode having at least four corners, and wherein said spring arrangement comprises a plurality of linear spring members extending from said inner corners of the square support frame to one of said corners of the rectilinear electrode away from an immediately adjacent inner corner of said support frame.

15. A MEMS device, according to claim 1 wherein:

said second electrode including a first plurality of slots therethrough arranged along a of diameter D1;

said top portion including a second plurality of slots therethrough arranged along a circle of diameter D2, where D1>D2, said second plurality of slots overlapping adjacent ones of said first plurality of slots.

16. A MEMS device according to claim 15 wherein:

the width W of each said slot is in the range of 0.1 μm to 1.0 μm so as to prevent unwanted particles greater than dimension W from entering the space between said first and second electrodes.

17. A capacitive type MEMS device comprising:

a substrate;

first and second opposed electrodes, said first electrode being positioned on said substrate;

a dielectric layer positioned on the surface of one of said electrodes, facing the opposing electrode;

a support and spring arrangement connected to said second electrode;

an electrostatic shield layer deposited on the surface of said dielectric layer;

a bleeder resistance connecting said electrostatic shield layer to ground potential;

said first and second opposed electrodes being drawn to one another upon application of a pull down voltage to one of said electrodes.

18. A capacitive type MEMS device according to claim 17 which includes:

first and second RF connectors respectively connected to said first and second electrodes.

19. A capacitive type MEMS device according to claim 17 wherein:

said bleeder resistance has a value of at least 10 megohms.

20. A capacitive type MEMS device according to claim 19 wherein:

said bleeder resistance is a resistor.

21. A capacitive type MEMS device according to claim 19 wherein:

said bleeder resistance is a reversed biased diode.

* * * * *